US006752144B1

(12) United States Patent
Lee

(10) Patent No.: US 6,752,144 B1
(45) Date of Patent: Jun. 22, 2004

(54) SMOKE GUIDING MACHINE

(75) Inventor: Shuei-Yuan Lee, Taipei (TW)

(73) Assignee: An New Industrial Co. Ltd., Taipei (TW)

( * ) Notice: Subject to any disclaimer, the term of this patent is extended or adjusted under 35 U.S.C. 154(b) by 0 days.

(21) Appl. No.: 10/615,982

(22) Filed: Jul. 10, 2003

(51) Int. Cl.[7] ..... F24C 15/20
(52) U.S. Cl. ..... 126/299 D; 454/192
(58) Field of Search ..... 126/299 R, 299 D, 126/299 F, 300, 303, 214 D; 55/DIG. 36; 454/66, 56, 188, 189, 192

(56) References Cited

U.S. PATENT DOCUMENTS 2,500,606 A * 3/1950 Dosmar ..... 454/188
3,559,636 A * 2/1971 Marino ..... 126/299 D
4,788,905 A * 12/1988 Von Kohorn ..... 454/189
5,042,456 A * 8/1991 Cote ..... 126/299 D
6,450,879 B1 * 9/2002 Suen ..... 454/192

FOREIGN PATENT DOCUMENTS

JP 2-272242 * 11/1990 ..... F24C/15/20

* cited by examiner

*Primary Examiner*—Josiah Cocks
(74) *Attorney, Agent, or Firm*—Bacon & Thomas PLLC

(57) ABSTRACT

A smoke guiding machine includes a front machine, and left and right machines, and is installed around a gas stove, thereby omnidirectionally isolating smoke produced. Tracks at two ends of the front machine are assembled to protrusions at left and right machines, and the protrusions are capable of displacing in channels at the tracks, so as to adapt to gas stoves having distinct dimensions. The front machine is further provided with a wind speed tuner, and thus appropriate wind speed can be adjusted and obtained for different wind speed requirement of different heights of smoke exhausts in various households.

4 Claims, 3 Drawing Sheets

SMOKE GUIDING MACHINE

BACKGROUND OF THE INVENTION (a) Field of the Invention

The invention relates to a smoke guiding machine, and more particularly, to a smoke guiding machine utilizing principle of wind walls and disposed around a gas stove. The smoke guiding machine according to the invention is capable of guiding smoke produced while cooking to an entrance of a smoke exhaust, thereby discharging the smoke to outdoors and omnidirectionally isolating the smoke.

(b) Description of the Prior Art

A common kitchen gas stove is provided with a smoke exhaust above for discharging smoke on top of the kitchen gas stove. However, for that a certain distance exists between the smoke exhaust and the gas stove, a suction range of the smoke exhaust cannot be effectively expanded. As a result, a portion of the remaining smoke still contaminates kitchen utensils, and even become hazardous to lungs when being inhaled.

Referring to the Taiwan Patent Publication No. 383088 disclosing "Wind Forwarding Device for Assisting Suction and Discharge of Smoke Exhaust" (to be referred to as the first cited invention), and Publication No. 479789 disclosing "Compelling Smoke Guiding Machine" (to be referred to as the second cited invention), wherein a positioning pole 3 is necessarily used for pivotally disposing a wind forwarding device 2 to a smoke exhaust 11 in the first cited invention. Yet, gas stoves 12 in each household come in distinct dimensions, meaning that gas stoves 12 having longer lengths or larger sizes are inapplicable to the first cited invention. In addition, the wind forwarding device 2 cannot be attached around the gas stove 12 for forming an integral.

A compelling smoke guiding machine A disclosed by the second cited invention has a rather complicated structure. The compelling smoke guiding machine A comprises mechanisms of a secondary arm 2, a pivotal arm 30, an end cover 40, a transmission axis cover 50, an interconnecting pole 60, a cover assembly 70, a blower 80 and a blower fan axis 90. Also, the smoke guiding machine A can merely be disposed in front of a gas stove 11, and thus fails to accomplish as an omnidirectional smoke-isolating device. Above all, the compelling smoke guiding machine A cannot be closed attached with the gas stove 11 for forming an integral.

In the first and second cited inventions, the wind forwarding device and the compelling smoke guiding machine are assembled using screw bolts and are hence manpower-consuming. Also, because the mechanisms have invariable dimensions and cannot be combined into integrals with common gas stove units having distinct widths and sizes. Furthermore, the prior mechanisms are inadaptable to different heights between smoke exhausts and gas stoves in various households, and appropriate wind speeds for forwarding smoke produced and required for facilitating discharge of the smoke cannot adjusted and obtained.

SUMMARY OF THE INVENTION

The primary object of the invention is to provide a smoke guiding machine comprising a track fastened at two ends of rear sides of a front machine, respectively, wherein each track is provided with a U-shaped channel; and a protrusion fastened at one side of left and right machines, respectively, wherein the protrusions are slid into the channels at the tracks of the front machine for combining the left and right machines to the front machine. Using displacement of the protrusions in the tracks, the invention is adaptable to gas stoves having distinct dimensions.

The other object of the invention is to provide a smoke guiding machine comprising beveled wind guiding leaves at inner edges of machine casings of the front machine, and the left and right machines, such that the wind guiding leaves are capable of complementing air flows at corners for facilitating forwarding smoke produced upward to reach a suction range of a smoke exhaust.

DETAILED DESCRIPTION OF THE PREFERRED EMBODIMENTS

To better understand the invention, detailed descriptions shall be given with the accompanying drawings hereunder.

Figure 1:
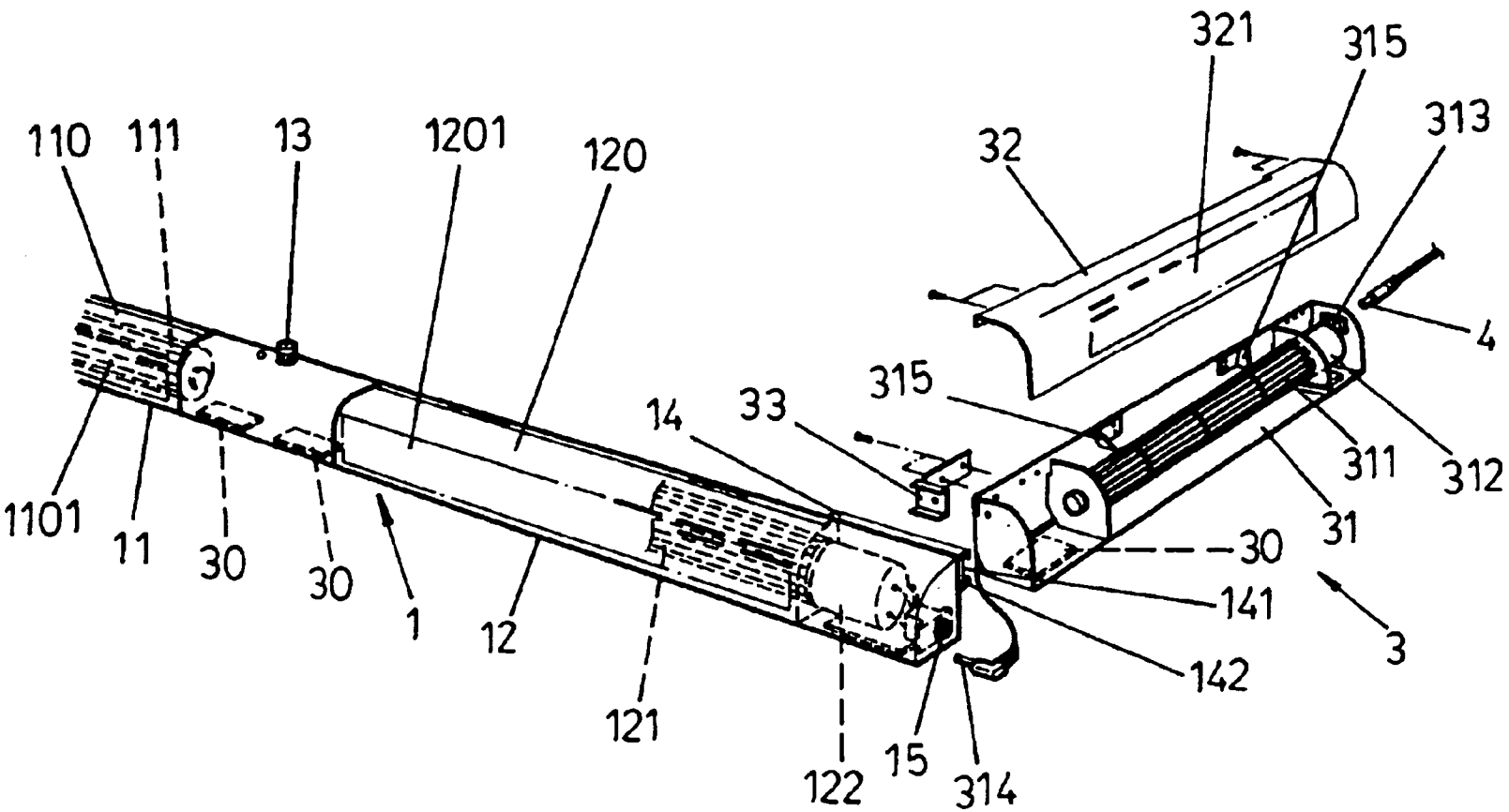
FIG. 1 shows an exploded partial view according to the invention.
Figure 2:
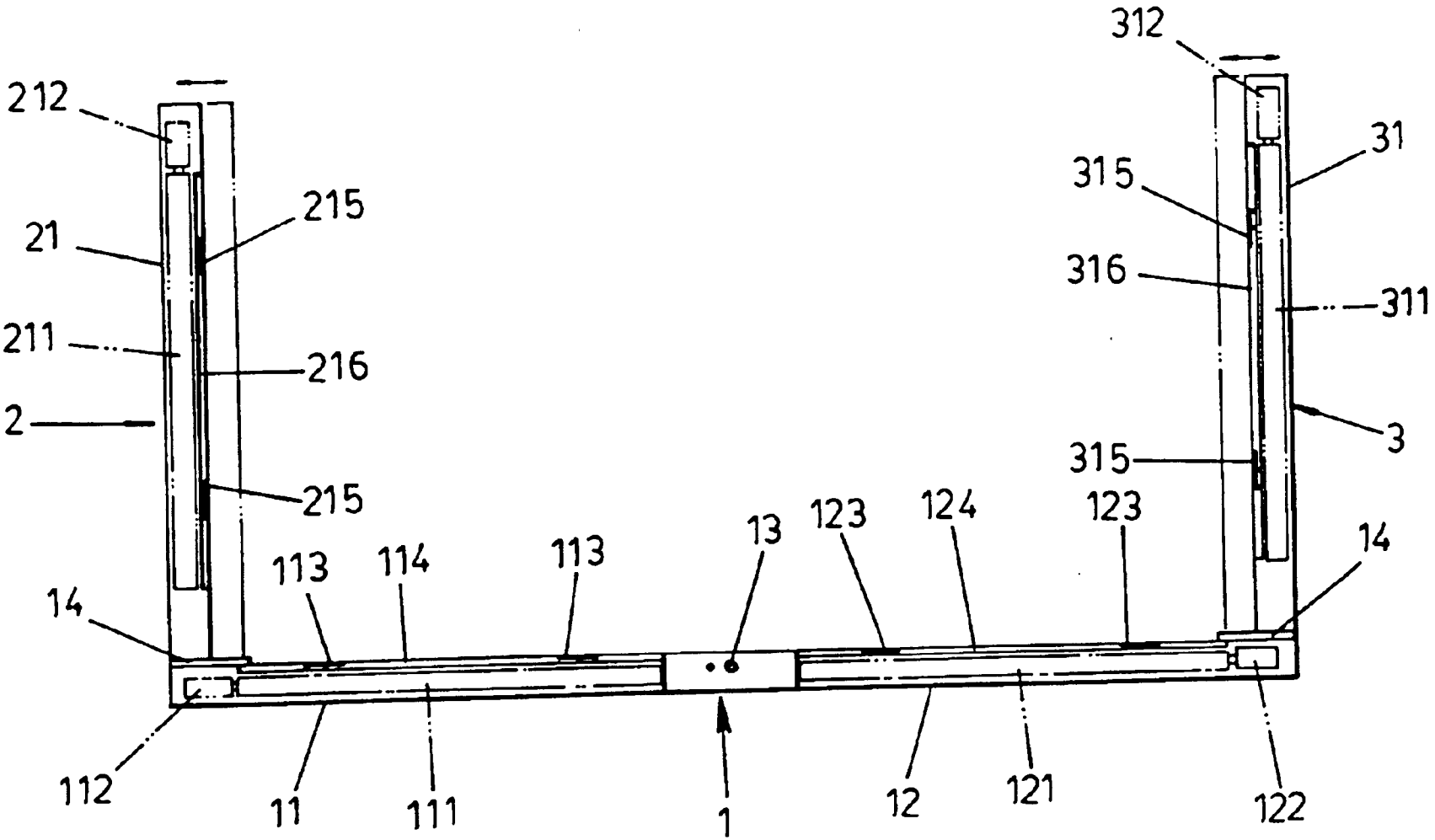
FIG. 2 shows a top sectional view according to the invention.
Figure 3:
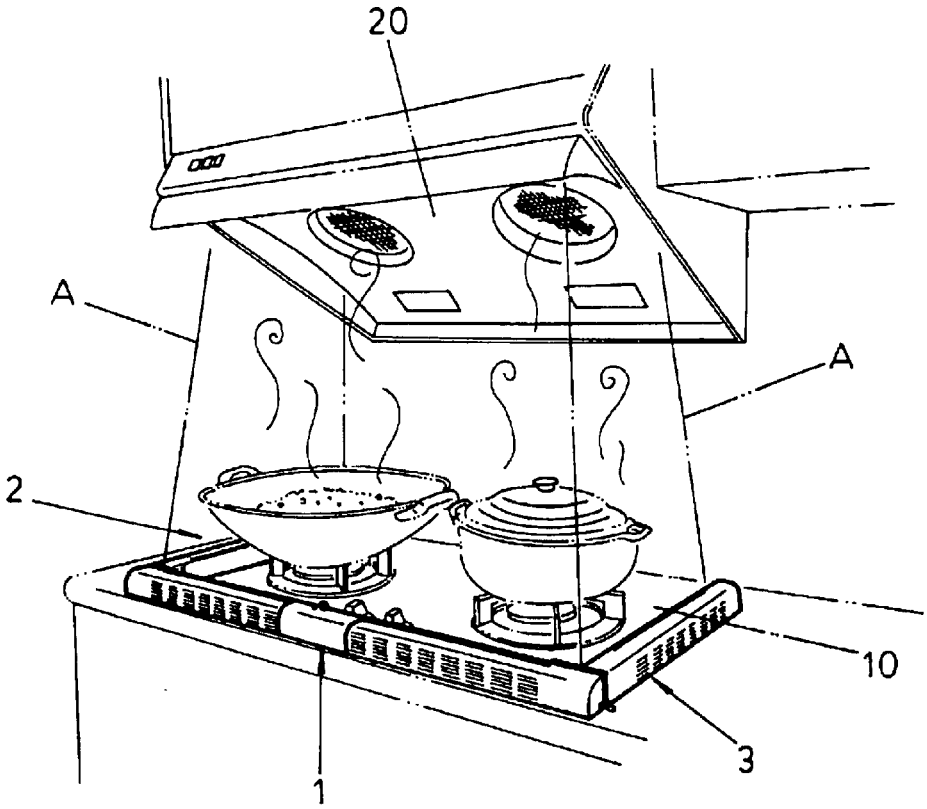
FIG. 3 shows an embodiment according to the invention.

Referring to FIGS. 1 to 3, the smoke guiding machine according to the invention comprises a front machine 1, a left machine 2 and a right machine 3 disposed at front, left and right of a gas stove 10, respectively, and forms an integral with the gas stove 10 (as shown in FIG. 3).

The front machine 1 is consisted of left and right casings 12 and 13, left and right casing covers 110 and 120, and a wind-speed tuner 13 fastened and connected between the left and right casing covers 110 and 120. The left and right casings 110 and 120 are disposed with wind inlet openings 1101 and 1201 at front edges thereof, respectively, and are provided with squirrel-cages 111 and 121, and motors 112 and 122 at interiors thereof, respectively. The squirrel-cages 111 and 121 are axially connected with axes of the motors 112 and 122, respectively, so as to have the motors 112 and 122 drive and rotate the squirrel-cages 111 and 121, respectively. Apart from for adjusting wind speed to an appropriate wind speed (heights of smoke exhausts in individual households are different, and therefore wind speed needed also varies), the wind-speed tuner 13 also serves as a power switch. The left and right casings 11 and 12 are further provided with a track 14 at rear ends thereof, respectively. Each of the tracks 14 has a U-shaped channel 141 at an interior thereof, and each channel 141 has a baffle 142 at an outer end thereof Moreover, each side board of the left and right casings 11 and 12 is provided with a power socket 15.

The left and right machines 2 and 3 are identical structures disposed at left and right sides of the front machine 1, respectively. FIG. 1 only shows an exploded view of the right machine 3. The left and right machines 2 and 3 are consisted of machine casings 21 and 31, and a casing cover 32, respectively. The machine casings 21 and 31 are provided with squirrel-cages 211 and 311, and motors 212 and 312, respectively. The squirrel-cages 211 and 311 are axially connected with axes of the motors 212 and 312, respectively, so as to have the motors 212 and 312 to drive and rotate the squirrel-cages 211 and 311, respectively. The casing cover 32 is disposed with a wind inlet opening 321. The machine casings 21 and 31 are provided with a power supply connector 313 at one side thereof and a power connector 314 at the other side thereof, respectively. The power supply connectors 313 are for inserting with power supply plugs 4, and the power connectors 314 are for respectively inserting into the power sockets 15 at the left and right machine casings 11 and 12 of the front machine 1. The left and right casings 21 and 31 are fastened with a U-shaped protrusion 33, respectively. The protrusions 33 are slid into the channels 141 at inner sides of the tracks 14 of the front machine 1, so as to fasten the left and right machines 2 and 3 at left and right sides of the front machine 1, respectively. In addition, the protrusions 33 are prevented from falling off using the baffles 142 at the outer ends of the channels 141.

Figure 4:
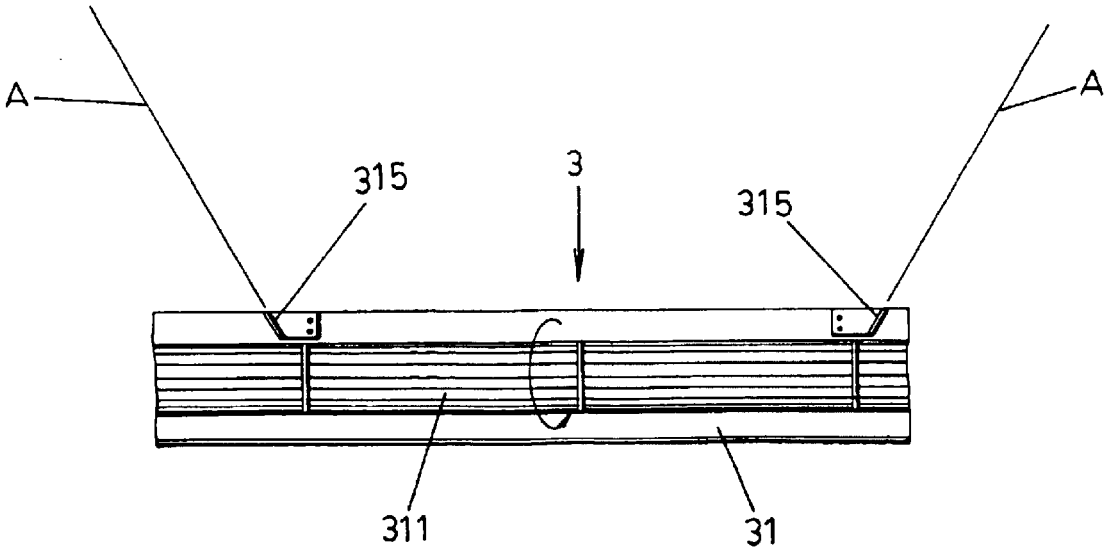
FIG. 4 shows a schematic view illustrating wind guiding operations of the wind guiding leaves according to the invention.

Moreover, rear inner edges of the machine casings 11, 12, 21 and 31 of the front machine 1, and the left and right machines 2 and 3 are adhered with two beveled wind guiding leaves 113 and 123, and 215 and 315 that complement insufficient air flows at corners, respectively. FIG. 4 shows a schematic view of an air wall A formed from wind guided by the wind guiding leaves 315 at the machine casing 31 of the right machine 3 (air walls A are similarly formed from wind guided by the wind guiding leaves 113, 123 and 215 of the front machine 1 and the left machine 2). When air flows produced by rotations of the squirrel-cages 111, 121, 211 and 311 driven by the motors 112, 122, 212 and 312 travel upward after passing through wind outlets 114, 214, 216 and 316, invisible (transparent) air walls A are formed as shown in FIG. 3. The airflows A omnidirectionally isolate smoke produced, and further facilitates forwarding the smoke upward to reach a suction range of a smoke exhaust 20.

In addition, bottom surfaces of the front machine 1, and the left and right machines 2 and 3 are adhered with shock-absorbent washers 30 for preventing noises that may be caused during operations of the smoke guiding machine as shown in FIG. 3.

Conclusive from the above, the invention can be installed around a gas stove to become an integral with the gas stove without requiring fastening devices such as screw bolts. Also, the protrusions at the left and right machines are capable of displacing within the channels of the tracks at two sides of the front machine for adapting to gas stoves having distinct dimensions. Above all, the wind speed tuner is utilized for adjusting to appropriate wind speeds desired according to different heights of smoke exhausts in various households.

It is of course to be understood that the embodiment described herein is merely illustrative of the principles of the invention and that a wide variety of modifications thereto may be effected by persons skilled in the art without departing from the spirit and scope of the invention as set forth in the following claims.

What is claimed is:

1. A smoke guiding machine comprising:

a front machine consisted of left and right casings, left and right casing covers, and a wind speed tuner fastened and connected between the left and right machine casings; wherein:

the left and right machine casings are provided with a squirrel-cage and a motor, respectively, thereby driving and rotating the squirrel-cages using the motors; and two rear ends of the left and right machine casings are fastened with a track, respectively, and each of the tracks is disposed with a channel further having a baffle at one end thereof;

a right casing consisted of a machine casing and a casing cover, and being provided with a squirrel-cage and a motor; wherein:

the motor is for driving and rotating the squirrel-cage; and the machine casing is fastened with a protrusion at one end thereof, and the protrusion is slid into the channel at the track of the front machine for assembling with the front machine; and a left machine having an identical structure as that of the left machine, consisted of a machine casing and a casing cover, and being provided with a squirrel-cage and a motor; wherein:

the motor is for driving and rotating the squirrel-cage; the machine casing is fastened with a protrusion at one end thereof, and the protrusion is slid into the channel at the track of the front machine for combining with the front machine; and the characteristics thereof being that the protrusions of the left and right machines displace and adjust positions thereof in the channels at the tracks of the front machine, thereby adapting to dimensions of common gas stoves.

2. The smoke guiding machine in accordance with claim 1, wherein inner edges of the machine casings of the front machine, and the left and right machines are fixed with two beveled wind guiding leaves, respectively.

3. The smoke guiding machine in accordance with claim 1, wherein side boards of the left and right machine casings of the front machine are provided with a power socket, respectively; the casings of the left and right machines are provided with a power supply connector at one end thereof and a power connector at the other end thereof, respectively; the power supply connectors are for inserting with power supply plugs; and the power connectors are inserted in the power sockets of the front machine, respectively.

4. The smoke guiding machine in accordance with claim 1, wherein bottom surfaces of the front machine, and the left and right machines are provided with shock-absorbent washers.

* * * * *